United States Patent [19]

Di Martino

[11] 3,973,684

[45] Aug. 10, 1976

[54] VERTICAL LOCKING SYSTEM FOR SHIPPING CONTAINERS

[76] Inventor: John M. Di Martino, 72 Lumur Drive, Sayville, N.Y. 11782

[22] Filed: June 5, 1974

[21] Appl. No.: 476,381

[52] U.S. Cl. ..... 214/10.5 R; 24/221 R; 105/366 R; 220/1.5

[51] Int. Cl.[2] ..... B65G 1/14

[58] Field of Search ..... 24/201 HE, 73 RM, 81 E, 24/221 R; 248/73, 223; 220/1.5; 312/111; 105/366 R; 403/292

[56] References Cited

UNITED STATES PATENTS

| | | | |
|---|---|---|---|
| 2,746,109 | 5/1956 | Budai | 312/111 |
| 3,191,777 | 6/1965 | Willits | 248/223 |
| 3,274,450 | 9/1966 | Siebold | 268/223 |
| 3,294,420 | 12/1966 | Martin | 220/1.5 |
| 3,387,571 | 6/1968 | Matushek | 105/366 R |
| 3,752,511 | 8/1973 | Racy | 403/292 |
| 3,753,272 | 8/1973 | Laidley | 24/81 E |
| 3,764,729 | 10/1973 | Kowalewski | 24/221 R |

*Primary Examiner*—Barnard A. Gelak
*Attorney, Agent, or Firm*—Robert A. Kelly

[57] ABSTRACT

Means for the releasable vertical securing of stacked shipping containers at their standard corner fittings, particularly in hard to reach areas in a block of containers, is provided by a unitary passive vertical connector having an extended planar base member with a canted post rising out of one extended surface and a flanged foot depending from the opposite extended surface. When the flanged foot is trappedly engaged in a corner-fitting recess of a first container, the canted post is steerably guidable into removable capture in a corner-fitting recess of the second container. A ramp surface, which can be a part of the canted post, interacts with a corner fitting as an upper container of a pair of containers gravitates into stacked relationship with a lower container, thereby generating a horizontal component of relative motion between the containers to steerably guide the canted post. The vertical connector can include means for forming a horizontal coupling with a substantially identical connector.

9 Claims, 14 Drawing Figures

FIG. 3
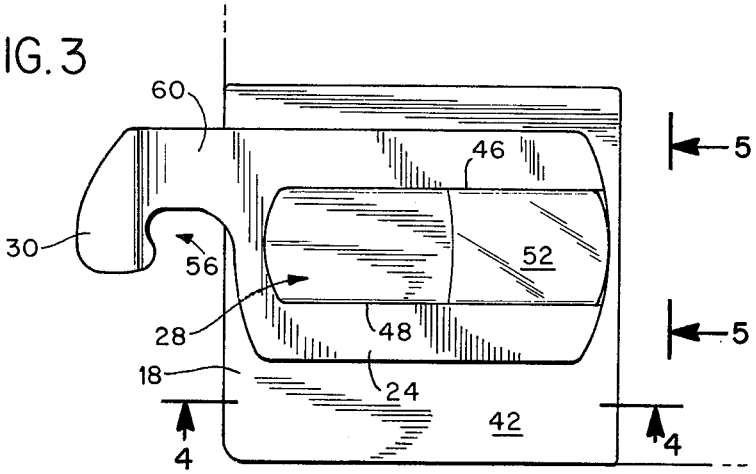
FIG. 4
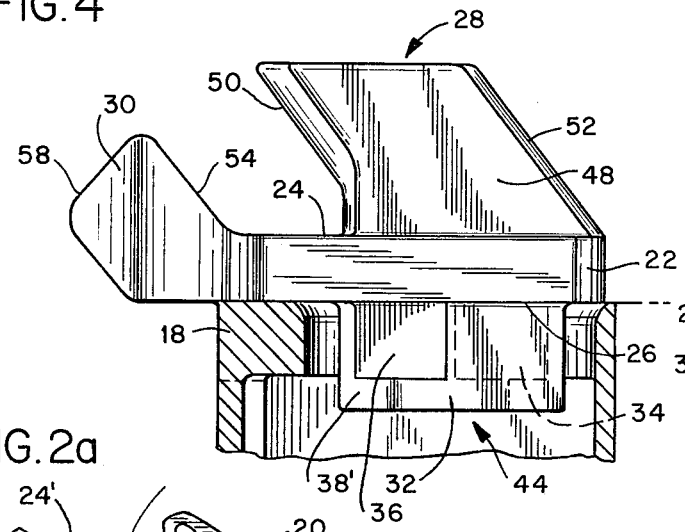
FIG. 5
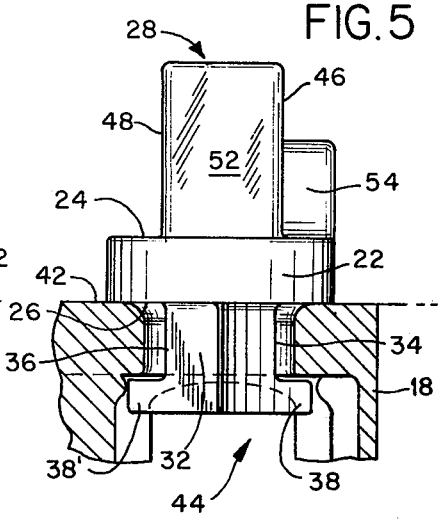
FIG. 2a
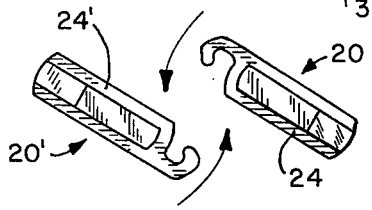
FIG. 2b
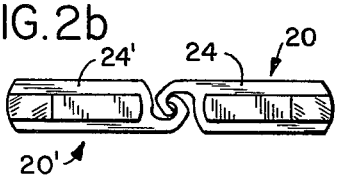
FIG. 4a
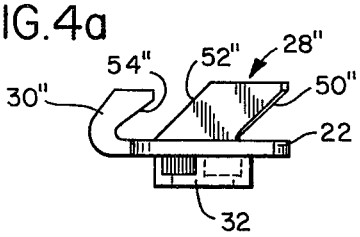
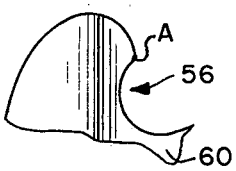
FIG. 6a
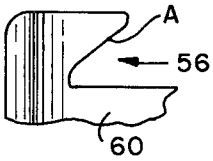
FIG. 6b
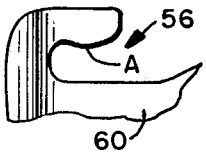
FIG. 6c
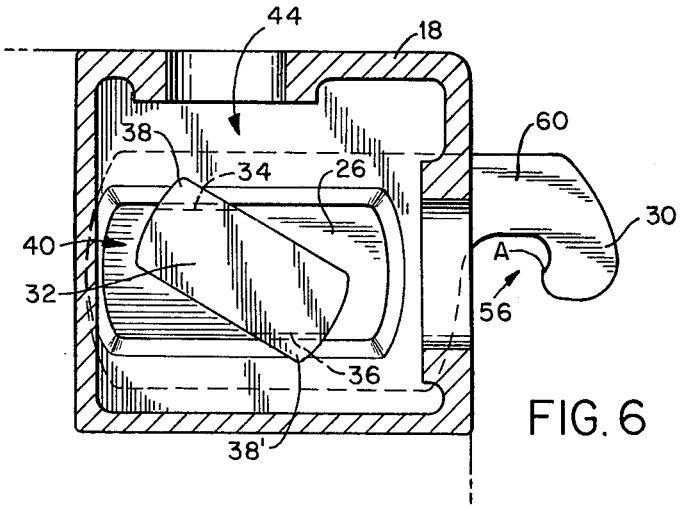
FIG. 6

VERTICAL LOCKING SYSTEM FOR SHIPPING CONTAINERS

BACKGROUND OF THE INVENTION

This invention refers to apparatus and methods for releasably securing a freight container of standard type (I.S.O. standard) to a loading platform and/or to another container within a stack of a multiplicity of such freight containers.

As is well known in the art, standard freight containers of the type described have at each corner a corner fitting in which there is an elongate orifice in the horizontal face, the orifice opening into a recess within the corner fitting.

The state of the prior art is summarized in U.S. Pat. No. 3,691,595 which teaches and claims a device for vertical lashing comprising a spring operated twist-lock which penetrates the elongate orifice. The device is activated automatically by a vertical compression caused by the weight of a container as the container gravitates into contact with an active member of the device so as to release a force to rotate the twist-lock to a locking position within the recess.

The device of U.S. Pat. No. 3,691,595, while substantially eliminating the drawbacks of the prior art, relies upon active elements for releasable lashing, which active elements require manual activation with a special tool to unlock the twist-lock. When the device is located in an interior position in a stacked block of containers, the procedure for unlocking is time consuming and hazardous, inasmuch as stevedores must climb up and down the container stack in order to activate each release mechanism. Thus the need still exists for a vertical fastener which does not require special tools or human interaction for its release and which will releasably lash containers together irrespective of the height and lateral interrelation between stacks within the same block.

Moreover, what is required is a simple device, preferably without active elements which can cause jamming through failure resulting from corrosion or misuse. The ideal device should be both rugged and inexpensive to manufacture.

SUMMARY OF THE INVENTION

These and other drawbacks of the prior art devices for lashing containers mutually in a vertical tier and to loading decks and the like are substantially eliminated in accordance with the present invention for releasable lashing of freight containers, wherein only passive elements are used in a unitary structure.

According to the practice of this invention, my new and novel vertical connector in its simplest embodiment comprises means for steerably guiding a canted post into removably captive relationship inside the recess of a corner fitting of a first container of a pair of containers through an elongate orifice in a horizontal face while the upper container of the pair of containers gravitates into stacked relationship with the lower container, and means for removably mounting the canted post on an appropriate corner fitting of a second container of the pair of containers.

Interaction of the post with the recess prevents vertical separation of the stacked containers, provided the stacked containers are kept under a restraint to prevent relative horizontal movement between the two containers as by use of a known horizontal restraint at a corner distant from the connector. Vertical separation and removal of the upper container is possible only when the horizontal restraint is removed. In the absence of the horizontal restraint, means for steerably guiding acts to free the post from captive relationship inside the recess when a vertical separation force is applied with respect to the containers.

A more complete understanding of the invention may be had by reference to the appended drawings when taken together with the description of the preferred embodiments.

BRIEF DESCRIPTION OF THE DRAWINGS

FIG. 2*a* is a schematic plan view of a pair of vertical connectors, positioned as if they were mounted on the corner fittings of a pair of containers already situate in adjacent relationship, prior to forming a horizontal coupling therebetween.

FIG. 2*b* is a schematic plan view of the vertical connectors of FIG. 2*a* after forming the horizontal coupling.

FIG. 3 is an enlarged view taken along 3 — 3 of FIG. 2.

FIG. 4 is a partially sectional, partially cutaway view taken along 4 — 4 of FIG. 3.

FIG. 4*a* is a schematic elevation on a reduced scale of an alternate embodiment of the connector of FIG. 4.

FIG. 5 is a partially cutaway view along 5 — 5 of FIG. 3.

FIG. 6 is an enlarged view, partially in phantom, along 6 — 6 of FIG. 2.

FIG. 6*a* is a fragmentary enlarged view of a portion of FIG. 6 rotated 180°, emphasizing the profile of the complex coupling surface of the connector of this invention.

FIG. 6*b* is a fragmentary view of an alternate embodiment for the profile of FIG. 6*a*.

FIG. 6*c* is a fragmentary view of a still further alternate embodiment for the profile of FIG. 6*a*.

DESCRIPTION OF THE PREFERRED EMBODIMENT

Figure 1:
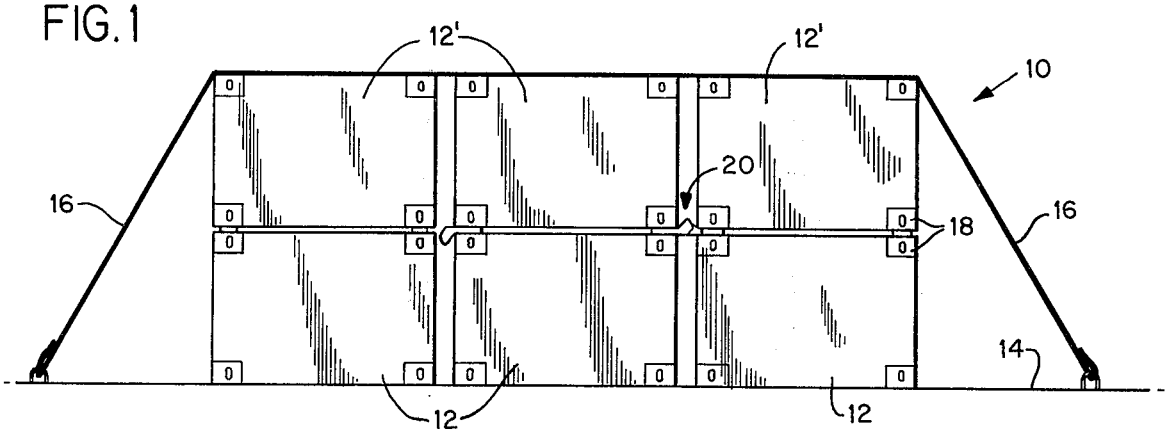
FIG. 1 is an elevation of a block of containers stacked in tiers and secured against vertical separation using vertical connectors of this invention.

Referring now to the various figures of the drawing, wherein like symbols indicate like elements, FIG. 1 shows a block of containers, indicated generally by 10, wherein each container 12, 12′ is arranged so as to form a plurality of adjacent tiers of containers with the upper containers secured to a deck 14 or the like by a lashing 16, as is known in the art, to prevent horizontal movement of the upper containers. Each container 12, 12′ is of the type having at all corners an I.S.O. standard corner fitting 18 with an orifice in each of its exterior surfaces, each orifice opening into a common interior recess. A unitary passive vertical connector 20 forms a fastening between a corner fitting 18 of a lower container 12 and the appropriate corner fitting 18 of an upper container 12' which is in stacked relationship with said lower container.

Connector 20 is located at what can be termed a "hard to reach" area of block 10, as will be understood by those skilled in the art to mean a location such as the mid-point of two 20-foot standard containers installed in a standard 40 -foot container space so as to have a 3-inch space between the facing adjacent ends of the containers, or, as illustrated in FIG. 1, the area defined by the container corners forming the 3-inch space between an interior container and an adjacent container installed in a standard 60-foot container space.

Figure 2:
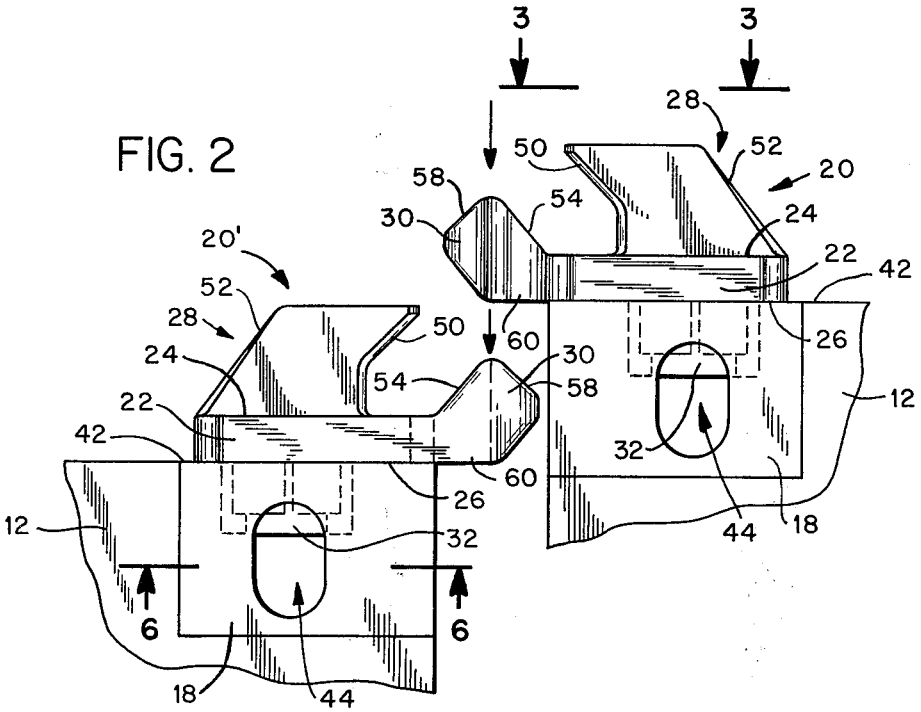
FIG. 2 is a fragmentary elevation of the facing top container corners of a pair of containers, each container provided with a vertical connector of this invention, in the act of being positioned into laterally adjacent relationship while simultaneously forming a horizontal coupling between the vertical connectors.

Connector 20, shown in FIG. 1, is a preferred embodiment of my invention which includes means for forming a horizontal coupling with a substantially identical like connector 20 mounted on a laterally adjacent container. FIG. 2 shows one method of forming such a coupling, wherein a first connector 20 is mounted on a corner fitting 18 of a first container 12 and a substantially identical second connector, designated 20', is mounted on a corner fitting 18 of a second container 12. Each connector 20, 20' comprises a base member 22 having an upper planar surface 24 and a substantially parallel lower planar surface 26, a canted post 28 rising from upper surface 24, and a nose 30 spaced apart from post 28 which extends outwardly from base member 22. Nose 30 includes means, hereinafter described, for forming a horizontal coupling with a substantially identical connector, said coupling stable against forces acting in a plane parallel to upper surface 24 provided that each connector 20, 20' forms a vertical fastening of the type described between a lower container and an upper container in a stacked relationship.

When the containers with preattached connectors, as shown in FIG. 2, are brought into horizontal adjacent alignment by vertical movement of a one of the containers, shown in the figure as a downward motion of the right hand container in the direction of the vertical arrows, the aforesaid means for forming a coupling forms a horizontal coupling between the two connectors as a result of their interaction by sliding engagement of a contacting coupling surface portion of the nose of each connector. An alternate method of forming the horizontal coupling between the connectors of two laterally adjacent containers already situate in proper spaced apart relationship in a row of containers is shown in the schematic of FIG. 2*a*, wherein a connector 20, 20' mounted on each of the corner fittings as will be described hereinafter, is rotated on an axis extending perpendicular to the plane of upper surface 24, 24', as indicated by the curved arrows, until both means for forming a coupling are engaged, as shown in FIG. 2*b*. When an upper container is then stacked on each of the said adjacent containers, a block of containers is formed with each upper container fastened to its lower container by a connector 20 and the horizontal coupling is made stable against forces acting in a plane parallel to upper surface 24.

A preferred means for removably mounting post 28 on corner fitting 18 is shown in the views of FIG. 4 through FIG. 6 as a flanged foot 32 having a first side 34 and a spaced apart substantially parallel second side 36, both sides depending substantially perpendicularly from lower surface 26 and terminating at outstanding flanges 38, 38' spaced apart from and substantially parallel to surface 26. The dimensions of foot 32 and of each flange 38, 38' are selected with reference to corner fitting 18 such that the flanged portion of foot 32 is removably insertable through elongate orifice 40 when connector 20 is in a first alignment, elongate orifice 40 forming a vertical opening in a horizontally disposed surface 42 of corner fitting 18, which opening connects with recess 44 within the corner fitting.

To mount connector 20 on corner fitting 18, the flanged end of foot 32 is first inserted through orifice 40 until surface 26 is in flush contact with surface 42 and each flange 38, 38' is within recess 44. The connector 20 is then rotated around an axis perpendicular to surface 26 to a second alignment where first side 34 and second side 36 are substantially parallel to the axis of elongation of orifice 40. Interaction of each flange 38, 38' with the interior of recess 44 prevents removal of foot 32 from orifice 40 until connector 20 is rotated back to the said first alignment.

Side members 46 and 48 of post 28, which rise perpendicularly from upper surface 24 of base member 22, are substantially parallel to side 34 and side 36 of foot 32 and are spaced apart from each other a distance determined by the width of orifice 40 as measured transverse to its axis of elongation, said distance such that rotation of connector 20 around an axis perpendicular to surface 26 is substantially prevented by interaction of side members 46 and 48 with the sides of orifice 40 when post 28 is in penetrating relationship with orifice 40. As a consequence of the interaction between the sides of orifice 40 and side members 46 and 48, foot 32 cannot be removed from a first orifice 40 when a first container and a second container in stacked relationship are vertically connected by a connector 20 with foot 32 in a first orifice 40 of a first corner fitting 18 of first container 12, with post 28 inserted through a second orifice 40 of a second corner fitting of the second container into its recess 44, and with surface 42 of the first corner fitting in flush contact with surface 26 and surface 42 of the second corner fitting in flush contact with surface 24.

Side 50 and side 52 of post 28 are substantially orthogonal to side members 46 and 48 and curved to conform to the ends of elongate orifice 40. Side 50 is inclined at an accute angle towards upper surface 24 of base member 22 and side 52 faces away from upper surface 24 at an obtuse angle. Side 50 and side 52 are spaced apart from each other such that post 28 is capable of penetration into recess 44 through a vertically facing orifice 40 of a corner fitting 18 until upper surface 24 is in flush contact with surface 42 of the fitting, said penetration possible only when there is a relative motion between connector 20 and orifice 40 which includes a component of motion which is parallel to surface 42. More specifically, the dimensions of post 28 are based upon the standard dimensions of corner fitting 18 such that the distance, measured in a plane parallel to side members 46 and 48 along upper surface 24, between the junction of upper surface 24 with side 52 and the perpendicular projection onto surface 24 of the outermost extremity of side 50, is greater than the length of elongate orifice 40 as measured along its axis of elongation; the distance, measured in a plane parallel to side members 46 and 48 and parallel to upper surface 24, between the outermost extremity of side 50 and side 52 is less than the said length of elongate orifice 40; the perpendicular distance, between upper surface 24 and the outermost extremity of side 50, is greater than the distance separating recess 44 from surface 42 of fitting 18; and the height of post 28 is less than the combined depth of orifice 40 and recess 44. As would be obvious to those skilled in the art, the relative placement of post 28 and foot 32 with respect to each other and with respect to base member 22 is determined with regard to standard corner fitting 18 so that a tier of containers vertically connected in stacked relationship by connector 20 will be substantially uniform and free from setback.

As a further means for assuring vertical stacking substantially free from setback, nose 30 includes an inclined surface 54 facing towards side 50 of post 28 and spaced apart therefrom a distance such that when surface 24 is in flush contact with surface 42 of corner fitting 18 the portion of surface 42 which lies between orifice 40 and the outer edge of the corner fitting in the direction of elongation of orifice 40 will fit therein.

Surface 54, substantially perpendicular to the plane of side member 48, can be inclined at an angle to surface 24 so as to provide a ramp surface for steerably guiding post 28 through orifice 40 and into recess 40. When inclined surface 54 is parallel to side 52 of post 28, both surface 54 and side 52 function as a ramp surface for steerably guiding post 28. When the obtuse angle between surface 24 and side 52 is greater than the corresponding obtuse angle between surface 24 and inclined surface 54, only surface 54 functions as a ramp surface during the vertical stacking and vertical connecting of a pair of containers.

Since side 50 of post 28 steerably guides post 28 out of recess 44 and orifice 40 during unstacking of a pair of tiered vertically connected containers, surface 54 can be parallel to side 50 or at some other angle whereby the distance separating surface 54 and side 50 varies directly as a function of the distance from surface 24 of base member 22.

From the foregoing descriptions of post 28 and nose 30 it will be apparent to those skilled in the art that there can be a considerable latitude in the angular dispositions of side 50, side 52, and surface 54 with respect to surface 24 without departing from the scope and teaching of this invention.

Nose 30 includes a complex coupling surface 56 (shown in FIG. 3) substantially perpendicular to planar surface 24 of base member 22, said coupling surface adapted to engagement with a substantially identical coupling surface to form a horizontal coupling as heretofore described. The profile of coupling surface 56 can be curvilinear or rectilinear, or a combination of curvilinear and rectilinear segments, as illustrated in FIG. 3, FIG. 6, FIGS. 6*a*, 6*b*, and 6*c*.

Whereas, all the coupling means having coupling surfaces with the profiles illustrated can form a horizontal coupling according to the method shown in FIG. 2, those coupling means whose profile of the coupling surface is shown in FIG. 3, FIG. 6, FIG. 6*a* and FIG. 6*b* can also form a horizontal coupling by the method of FIGS. 2*a* and 2*b*.

Although the profile of coupling surface 56 can have many forms within the scope of this invention, it is critical that coupling surface 56 have a profile which is substantially rotationally symmetric about a point on the profile, said point (labeled A in FIGS. 6, 6*a*, 6*b* and 6*c*) in the plane parallel to side members 46 and 48 and spaced midway therebetween. By rotationally symmetric I mean that the coupling surface profile between said point and base extension 60 includes a segment, starting at said point, which is a 180° rotational transformation about the said point of the remainder of the profile beyond the said point.

When a horizontal coupling of the type described is formed by the engagement of a coupling surface 56 of a first connector with a coupling surface of a substantially identical second connector, inclined surface 58 of said first connector is substantially coplanar with inclined surface 54 of said second connector and the apex of each nose 30, where surface 54 and surface 58 converge, is spaced midway between the sides of the laterally adjacent containers which are so coupled.

Figure 7:
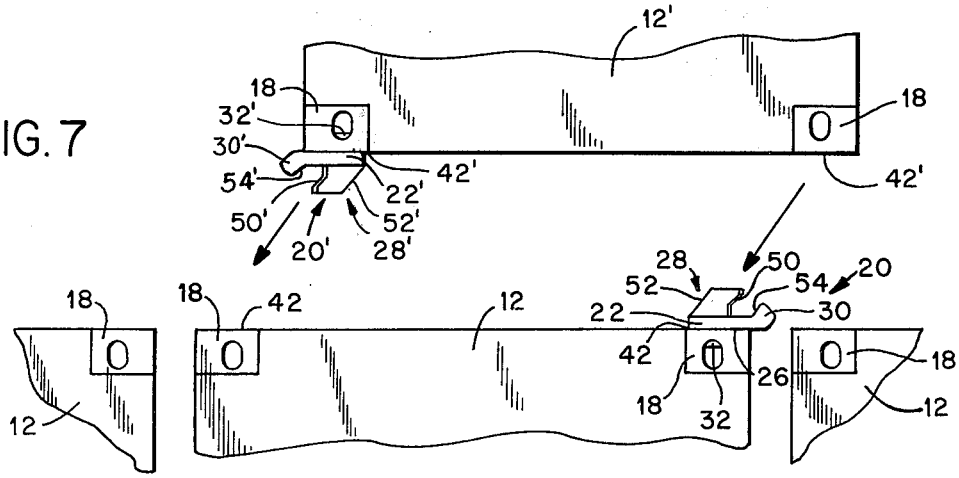
FIG. 7 is a fragmentary elevation view illustrating the act of vertically stacking a pair of containers each of which is provided with a vertical connector of this invention.
Figure 8:
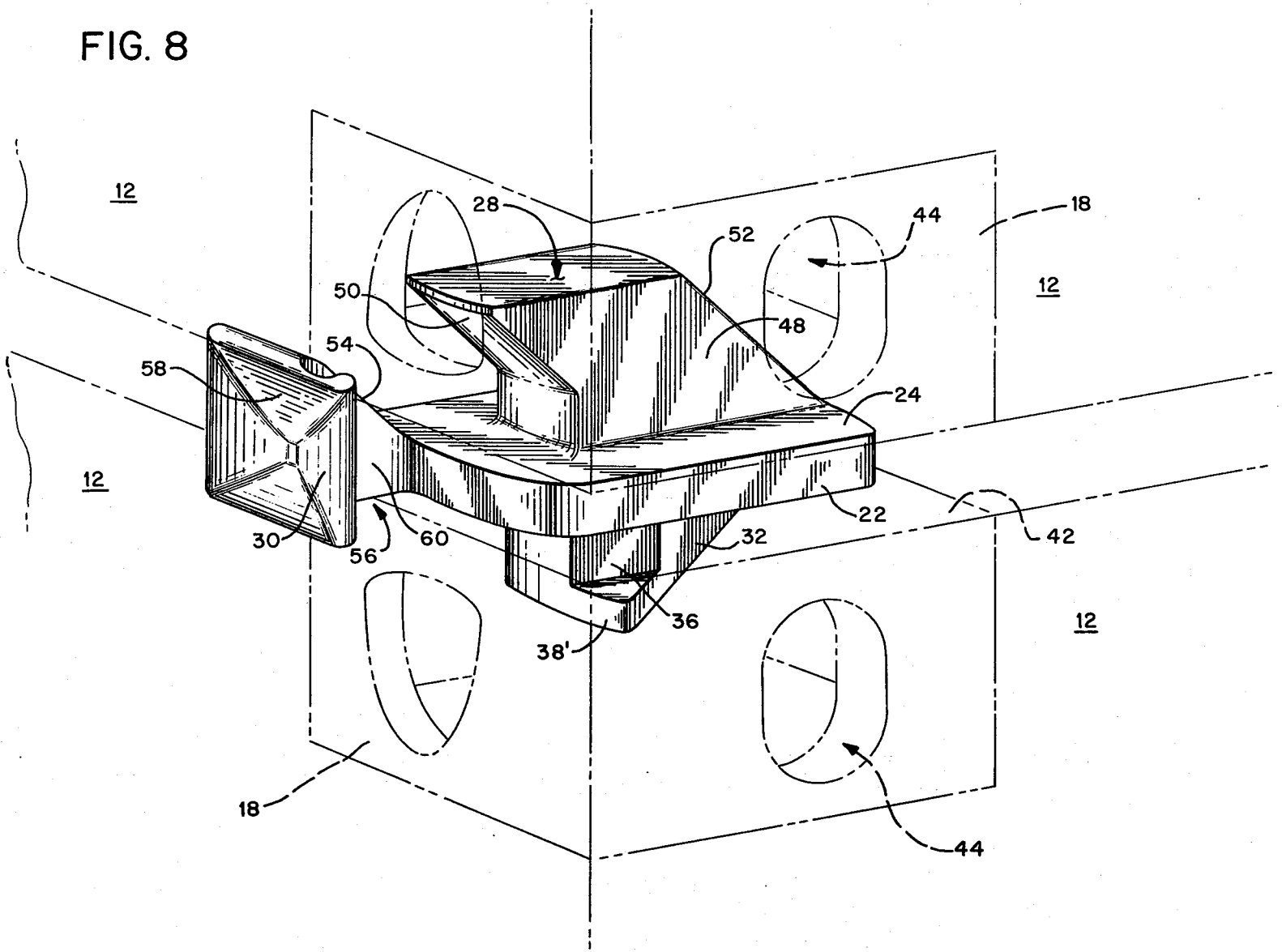
FIG. 8 a perspective view of the connector of this invention as shown in engagement with an upper and lower container.

Now, having described in detail the structure of the preferred embodiment of my invention, a more comprehensive understanding of the working of my invention can be had by reference to FIG. 7 which shows an upper container being gravitated into stacking relationship with a lower container, both containers to form a tier lashed vertically by the unitary passive vertical connector of my invention. As shown, a first connector 20 is mounted on a lower container 12 and a second connector 20' is mounted on the upper container, as heretofore described, with base member 22 of connector 20 in flush contact with the horizontally disposed surface of corner fitting 18 and with canted post 28 pointing upwardly and outwardly towards the end of container 12, and with base member 22' substantially parallel to the horizontally disposed lower surface of container 12', canted post 28' pointing downwardly away from connector 20 so that surface 54 and surface 54' are substantially parallel, foot 32 and foot 32' each being trappedly engaged in the recess of its respective corner fitting. AS upper container 12' is gravitated towards lower container 12, the resultant interaction of the ramp surface of each connector with its facing corner fitting generates a relative component of motion between the containers in a horizontal direction, the resultant motion being in the direction of the arrows, thereby steerably guiding each post into the elongate orifice of the facing container until each post is engaged in a recess and each member is in flush contact with the corner fitting of both the upper and the lower containers.

When it is desired to form a horizontal coupling between a centrally located tier of containers, as in being formed in FIG. 7, with a laterally adjacent tier of containers on one side thereof, to correspond to block 10 of FIG. 1, the horizontal coupling shown at the right hand side of FIG. 1 is formed prior to forming the central tier, according to the method of FIG. 2 or FIGS. 2*a* and 2*b*.

FIG. 4*a* shows an alternate embodiment of the connector of this invention wherein post 32 and planar base member 22 are substantially unchanged from the previously described embodiment and canted post 28'' has side 50'' at an accute angle and side 52'' at an obtuse angle to the plane of base member 22 with inclined surface 54'' of nose 30'' facing side 52''. Because of the nonsymmetric location of elongate orifice 40 with respect to recess 44 of a standard corner fitting 18, engagement of post 28'' within recess 44 cannot be fully relied upon for vertical lashing, and surface 54'', which is modified to penetrate the end orifice (not shown) of fitting 18, provides the necessary vertical restraint by penetration into the end orifice as post 28'' is steerably guided through orifice 40 into recess 44.

Whereas, all the views of the drawing which show foot 32 or coupling surface 56 depict a common configuration, which I chose to call a right-hand configuration, with the profile of the coupling surface hooking counter-clockwise when viewed from above, it will be obvious that the connector of my invention can function equally well in a left-hand configuration. The connector with left-hand configuration can have an additional non-obvious application in the method of my invention. Thus, using a vertical connector having a left-hand configuration, a horizontal coupling between container 12 at the left hand side of FIG. 1 and the central tier can be formed, according to the method of FIG. 2, if the said container 12 has a left-hand configuration connector mounted thereon and is gravitated into position adjacent the preformed central tier to effect interaction by sliding engagement of the contacting coupling surface portions of the nose of each connector, container 12' of the central tier having a connector mounted as connector 20' of FIG. 7. Alternatively, if connector 20' of FIG. 7 has a left-hand configuration, the said container 12 can have mounted thereon a connector having a right-hand configuration.

In this specification and the accompanying drawing certain obvious refinements have been omitted until this time for simplicity of presentation. Now, such refinements can be explained in the light of the teachings of this invention, without confusing the issue of invention. Since, for economy, it is contemplated that the vertical connector be a unitary metal casting, it will be obvious to those skilled in the art to round off edges and corners, wherever metal to metal contact can occur during the intended use of the connector; to provide a frustropyramidal ridge on the top of post 28 to facilitate entry into orifice 40; and to provide relief wherever the weight of metal or its cross-section can be reduced without sacrifice of function or strength. Thus, it is obvious that post 28 can be pierced perpendicularly to side members 46 and 48; that foot 32 can be channeled so as to form two sub-units, with each subunit immediately adjacent a side 34, 36; and base member 22 can be reduced substantially in area to a limiting condition wherein the base member comprises a pair of struts, with each strut extending parallel to flanges 38, 38' from a respective side 34, 36 of foot 32, one strut connecting with base extension 60.

As would further obvious to one skilled in the art, connector 20 can be made other than by casting, as by the welding of rods, shapes, and the like, to provide a skeleton outline version of the invention, provided that the critical surface arrangement of sides 34, 36 with flanges 38,38'; side 50 and side 52 with surface 24; flanges 38,38' with surface 26; surface 54 with sides 50 and 52; and side members 46,48 with side 50 and side 52 as well as sides 34, 36 are maintained in their proper relationship as heretofore described.

Whereas, the preferred embodiment for general application includes means for forming a horizontal coupling, as has been described and illustrated, there may be applications where a horizontal coupling is neither needed nor desired. It is obvious that such a connector can be made according to the teachings of this invention merely by elimination of the complex coupling surface and shortening the nose, or by elimination of the base extension and nose. Other equally obvious varients of the invention include a vertical connector with means for forming a horizontal coupling in which there is no surface 54 on nose 30; and a vertical connector having only a base member, a flanged foot, and a canted post, with the canted post rotated 90° so that side members 46 and 48 extend orthogonally to side 34 and side 36 of foot 32. Obviously, in this last discussed embodiment, the dimensions and angles of the sides and surfaces of post 28 must be modified and adjusted in accordance with the teaching of this invention so as to make post 28 steerably guidable into removable capture in recess 44 through orifice 40 in a direction transverse to the axis of elongate orifice 40.

What is not so obvious, is that an otherwise normal embodiment of this invention preferably without base extension and nose, if post 28 has been pierced and tapped, can be used also as a combined vertical and horizontal restraint, when located at an accessible face of a block of containers and a suitable bolt is threaded into the tapped post through a side facing orifice.

Having thus described the invention as required by statute, what I desire to claim and secure by Letters Patent is:

1. A one piece passive vertical connector made of inflexible material for stackable containers, said containers of the type having an I.S.O. standard corner fitting at each of the corners thereof, said corner fitting having orifices in the outer surfaces thereof, said orifices opening into an inner recess in said fitting, said connector comprising:

means defining a planar base member;

foot means depending from said base member substantially within its periphery, said foot means having shoulder portions thereon for engaging the inner surface of the corner fitting, said foot means insertable through a first orifice in a horizontally disposed surface of a said corner fitting of a first container and twistingly engagable in a first said recess;

post means extending upwardly from said base member substantially within its periphery, a first side of said post means forming an acute angle with and facing said base member, said post means removably penetrable into a second said recess through a vertically facing second orifice in a horizontally downward facing disposed surface of a said lower corner fitting of a second container only when there is a horizontal component of relative motion between said connector and said second container;

and, a first ramp surface formed on a second side of said post means extending at an obtuse angle and facing away from said base member for guiding said second container as the latter is lowered into engagement with said connector said first side and said second side being on opposite sides of said post means, and that the projection of said post means on said base member has at least one dimension which is larger than a corresponding dimension of the orifice of the container into which it is being inserted.

2. The connector of claim 1 wherein said foot means includes flanges penetrable through said first orifice when said connector is in a first alignment and incapable of withdrawal from said first orifice when said connector is in a second alignment.

3. The connector of claim 2 wherein a said first side of said post means comprises a second ramp surface in alignment with said first ramp surface for guiding said second container as the said second container is removed from engagement with said first container.

4. The connector of claim 3 wherein a nose means extends from said base member in the plane of said base member, said nose means having a third ramp surface, said third ramp surface being in alignment with said second ramp surface so as to form a channel means between the second and third ramp surfaces to enable them to position said container.

5. The connector of claim 4 wherein said nose means includes coupling means for forming a horizontal coupling with a substantially identical said connector on a third container situated horizontally adjacent to said first container.

6. The connector of claim 5 wherein said coupling means comprises a coupling surface substantially perpendicular to said base member.

7. The connector of claim 6 wherein said coupling surface is rotationally engagable with a substantially identical said coupling surface of a said connector on said third container.

8. The connector of claim 6 wherein said coupling surface is vertically engagable with a subtantially identical said coupling surface of a said connector on said third container while said third container is being vertically positioned horizontally adjacent said first container.

9. The connector of claim 6 wherein the dimension of said post means which is perpendicular to said first side is substantially equal to the corresponding dimension of said second orifice.

* * * * *